United States Patent [19]

Kumagai

[11] Patent Number: 4,562,518

[45] Date of Patent: Dec. 31, 1985

[54] LIGHT ASSEMBLY FOR USE ON VEHICLES

[75] Inventor: Toji Kumagai, Hadano, Japan

[73] Assignees: Ichikoh Industries Limited, Tokyo; Yugen-Gaisha Shiba Seisakusho, Ebina, both of Japan

[21] Appl. No.: 615,464

[22] Filed: May 30, 1984

[30] Foreign Application Priority Data

May 31, 1983 [JP] Japan ..... 58-94991

[51] Int. Cl.[4] ..... F21V 21/00

[52] U.S. Cl. ..... 362/249; 362/382; 339/119 L; 339/176 L

[58] Field of Search ..... 362/249, 382, 457, 227, 362/61; 339/119 L, 125 L, 176 L

[56] References Cited

U.S. PATENT DOCUMENTS

| | | | |
|---|---|---|---|
| 913,805 | 3/1909 | Bronaugh | 362/249 |
| 1,818,884 | 8/1931 | Eckstein | 21/48 |
| 3,125,299 | 3/1964 | Woofter et al. | 362/382 |
| 4,040,709 | 8/1977 | Dola et al. | 339/125 L |
| 4,423,475 | 12/1983 | Bärtl | 362/249 |

FOREIGN PATENT DOCUMENTS 2421422 11/1975 Fed. Rep. of Germany ... 339/176 L

*Primary Examiner*—Andrew M. Dolinar

*Attorney, Agent, or Firm*—Schwartz, Jeffery, Schwaab, Mack, Blumenthal & Evans

[57] ABSTRACT

A light assembly for use on vehicles in which a back plate on which a plurality of light bulbs is disposed, a housing to which said back plate is fixed and lens member disposed opposite to said back plate and which covers the opening of said housing, comprising electroconductive sockets to support said light bulbs, respectively, insulative socket holders to hold said sockets on the back plate, respectively, terminals electrically connected to said sockets, respectively, and an earth wire both electrically connected between said terminals and connected to the earth; said earth wire being made of a coated conductor and stripped at portions corresponding to said terminals, respectively, each of said terminals having formed thereon a pair of tongues which grasps said stripped portion of the conductor.

5 Claims, 9 Drawing Figures

LIGHT ASSEMBLY FOR USE ON VEHICLES

BACKGROUND OF THE INVENTION (a) Field of the Invention

The present invention relates to a light assembly for use on vehicles, and more particularly to a light assembly in which a plurality of light bulbs can easily be wired together for earthing.

(b) Description of the Prior Art

In a so-called rear combination light having therein a plurality of light bulbs, such as an automotive rear light, each light bulb is fitted in an electroconductive socket which is supported on a light bracket by means of a socket holder made of an insulative material such as synthetic resin. Usually, the sockets, in each of which a light bulb is fitted, are connected to each other by means of earth wires and earthed by means of a portion of a connector fixed to the light bracket. The electrical connection among the plurality of sockets is established by connecting electroconductive terminals, connected to the respective sockets to each other by means of coated conductors. Specifically, each of the terminals is in contact with the socket, at a first end of the terminal fitted between the socket and socket holder. At a second end, the terminal comprises a conductor connector for connection with one end of the conductor. For example, in a rear combination light incorporating three light bulbs, first, second, and third terminals are provided for the three light bulbs, respectively. For electrical connection between these terminals, a coated conductor or wire is previously cut to a length corresponding to the spacing from one terminal to another. Both ends of the coated conductor thus cut are stripped to a length corresponding to the size of the conductor connector of each terminal, and, finally, the stripped portion of the conductor is connected to the conductor connector of each terminal by crimping or pressing. In this case, earth wires are connected between the first and second terminals, second and third terminals, and between the third terminal and earth wire lead-out connector, respectively. That is to say, the second and third terminals have conductor connectors in 2 places, which requires two connections of the conductor for each of these second and third terminals. Such connections are usually done by hand-work, and two conductors should be connected to each of the terminals except for the first one. Furthermore, the necessity of tieing together the stripped portions of each coated wire at both ends thereof at the time of such work of connection will make the work very difficult and complicated.

SUMMARY OF THE INVENTION

The present invention provides a light assembly for use on vehicles, which is so constructed as to facilitate the connection of earth wire between sockets in which a plurality of light bulbs is fitted, respectively.

The present invention is directed to an improved light assembly for use on vehicles in which a plurality of light bulbs is disposed on a back plate, the back plate is fixed to a housing, and, a lens member, disposed opposite to the back plate, covers the opening of the housing. The light assembly according to the present invention comprises electroconductive sockets to support the light bulbs, respectively, insulative socket holders to hold the sockets on the back plate, respectively, terminals electrically connected to the sockets, respectively, and an earth wire both electrically connected between the terminals and connected to the earth. The earth wire is made of a coated conductor and stripped at portions corresponding to the terminals, respectively. Each of the terminals comprises a pair of tongues which grasps the stripped portion of the conductor.

These and other objects and advantages of the present invention will be better understood from the ensuing description made of the embodiment by way of example of the present invention with reference to the drawings.

BRIEF DESCRIPTION OF THE DRAWINGS

FIGS. 1 to 7 show on embodiment of light assembly for use on vehicles according to the present invention, in which FIG. 1 is a front view of the back plate on which the light bulbs are secured;

FIG. 2 is a sectional view taken along the line II—II in FIG. 1, showing the housing and lens member with two-dot dash lines;

FIG. 3 is a view of the earth wire, enlarged in scale;

FIG. 4 is a perspective view, enlarged in scale, of the terminal;

FIG. 5 is also a perspective view, enlarged in scale, of the earth wire and each terminal as connected;

FIG. 6 is a sectional view taken along the line VI—VI of FIG. 5;

FIG. 7 is a schematic perspective view showing the socket and terminal as connected;

FIGS. 8 and 9 show a modification of the pair of grasping tongues in each terminal, of which FIG. 8 is a perspective view, enlarged in scale, of the pair of grasping tongues; and FIG. 9 is a perspective view showing the earth wire and grasping tongues as connected.

DETAILED DESCRIPTION OF THE PREFERRED EMBODIMENT

Figure 1:
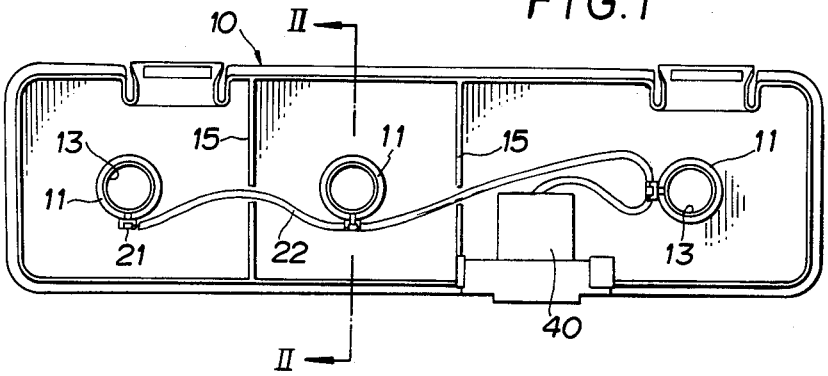
Figure 2:
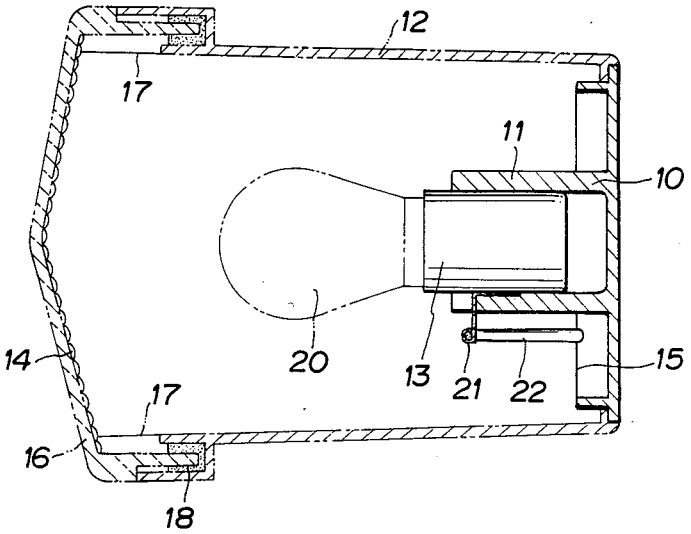

FIGS. 1 to 7 show an embodiment of the inventive light assembly. This embodiment is applied to an automotive rear combination light. In the Figures, the reference numeral 10 denotes a back plate on which, for example, three light bulbs 20 are disposed. The back plate 10 is fitted at the outer circumference thereof in a housing 12, covering the opening at one end thereof. Provided on the opening at the other end of the housing 12 is a lens member 16 having a prism 14 on the inner surface thereof. The lens member 16 is fixed to the end of the housing using an adhesive 18. The back plate 10, housing 12 and lens member 16 are made of a synthetic resin. The housing 12 is to be fixed to the rear of an automobile.

The back plate 10 has three integral socket holders 11 in each of which an electroconductive socket 13 for supporting one light bulb 20 is fitted. Also, the back plate 10 has two integral partitions 15 according to the locations of the three light bulbs 20. The housing 12 has formed at the portions thereof corresponding to the partitions 15 shielding walls 17 which shield the light from the light bulbs 20, respectively.

A portion of a terminal 21 is provided pressed between the socket holder 11 and socket 13, and an earth wire 22 is connected between connectors formed on each terminal 21. In the Figures, the positive-side wire of the light bulb 20, namely, the power wire to each bulb, is omitted for the simplicity of the illustration, but such wires are connected in practice to a portion of connector 40 which will be described later.

Figure 3:
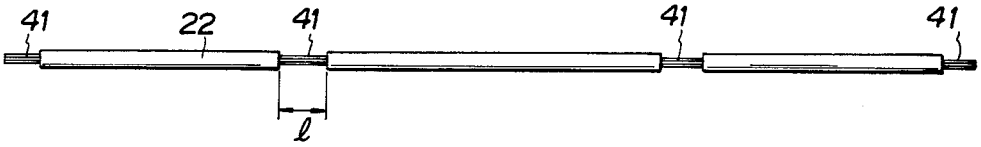
Figure 4:
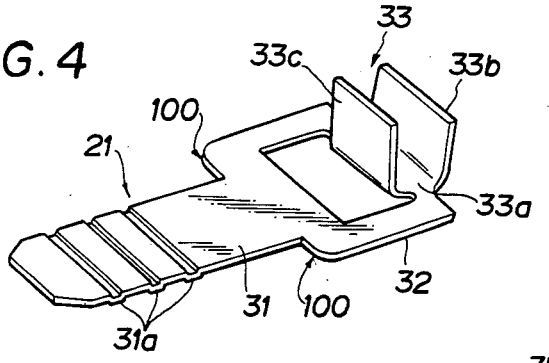
Figure 7:
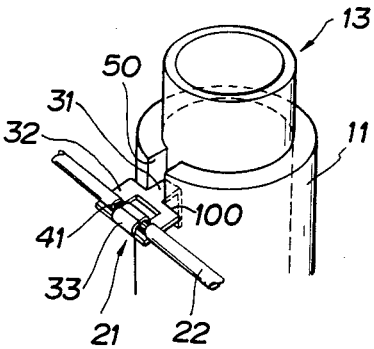

In a preferred embodiment, the earth wire 22 is a single wire as shown in FIG. 3, and it has a naked conductor portion 41 formed at a position corresponding to each terminal 21 of the earth wire 22 by stripping the sheath or coating on the earth wire 22. On the other hand, as shown in FIG. 4, the terminal 21 is made of an electroconductive metal plate, and comprises a body 31 and a wide connector 32 formed at one end of said body 31. The body 31 is inserted into the socket holder 11, and the socket 13 is also fitted into the socket holder 11, thus keeping the body 31 pressed between the socket 13 and socket holder 11 as shown in FIG. 7. In this case, a plurality of ribs 31*a* are formed as raised on one side of the body 31 while being concave at the other side. The ribs 31*a* are forcibly pressed between the socket 13 and socket holder 11 when the body 31 is inserted between them, permit the terminal 21 to be secure held, and also provide an electrical connection between the terminal 21 and socket 13.

Figure 5:
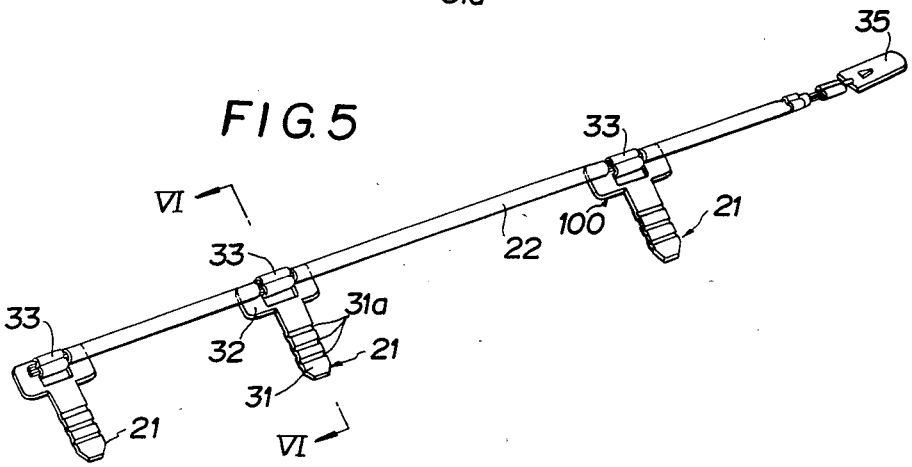
Figure 6:
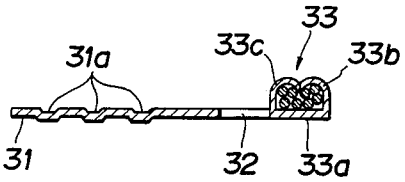

The connector 32 has formed thereon a pair of grasping tongues 33 for connecting with the naked portion 41 of the earth wire 22. The pair of grasping tongues is formed by bending to a U-shape an extension 33*b* formed at one end of the connector 32 and a piece 33*c* formed by cutting the connector 32. By placing the naked portion 41 of the earth wire 22 between these tongues and calking or crimping them, the naked portion 41 can be grasped by both of them. The tongue 33 has a width a little less than the width l of the naked portion 41 of the earth wire, so that the tongues can be generally put into contact with the naked portion 41 thus ensuring a positive connection between them. FIG. 5 shows the earth wire 22 and each terminal 22 as connected to each other. The reference numeral 35 indicates a terminal connected to one end of the earth wire 22, and it is in turn connected to the earth by means of the connector 40 fixed to the back plate 10. In order to position the terminal 21, the socket holder 11 has formed therein a cut 50 for engagement of the body 31 of the terminal 21 with the wall near the opening of the socket. When inserting the terminal 21 between the socket 13 and socket holder 11, the body 31 is bent and engaged in the cut 50, as shown in FIG. 7, so as to permit positioning of each terminal 21 in each socket holder 11. Preferably the terminal 22 comprises shoulder portions 100 for being pressed against the outer wall of the socket holder 11, and for supporting the terminal in the cut 50.

In the embodiment having been illustrated and described, for the connection between the earth wire and each socket 13, a sheathed wire previously cut to an appropriate length should preferably be stripped at positions 41 corresponding to those of the sockets 13. The pair of tongues 33 are calked to connect each terminal 21 and 35 to the naked portion 41 of the earth wire. Each terminal 21 is inserted between the socket 13, and socket holder 11 and the terminal 35 are connected to the connector 40 as well. For making the connection, only a single earth wire is stripped at necessary portions thereof, so that the stripping can be automated. Since each terminal 21 is provided with a pair of tongues 33, the above connection can be made with only one calking per each terminal, for thereby enabling smooth calking. The calking can also be automated.

Figure 8:
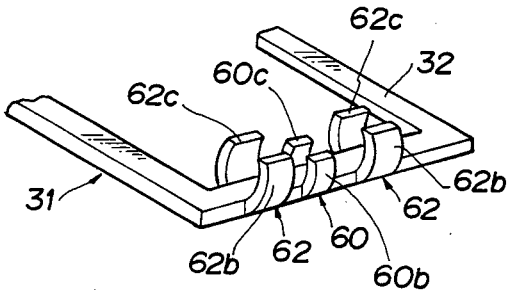
Figure 9:
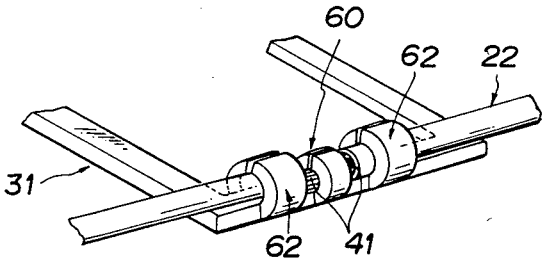

In the embodiment having been described in the foregoing, each terminal has a pair of grasping tongues which grasp, as calked, only the naked portion of the earth wire. According to another embodiment of the present invention, other pairs of such grasping tongues may be formed on each terminal to grasp coated or sheathed portions adjoining the naked portion of the earth wire. FIG. 8 shows such a variation of the inventive grasping tongue pair. Each terminal 31 has formed at one end thereof a pair of grasping tongues 60 for connection to the naked portion of the earth wire 22, and at either side of this first pair of grasping tongues 60, additional pairs of grasping tongues 62 for grasping a sheathed portion of the earth wire. The pair 60 for grasping the wire conductors is formed by bending to a U-shape tongues 60*b* and 60*c* formed at the end of the terminal. The other pairs 62 for grasping the sheathed portion of the earth wire are formed each by bending to a U-shape tongues 62*b* and 62*c*, spaced from the pair 60 at either side thereof, and the other pairs 62 are somewhat longer than the tongues 60*b* and 60*c*. The naked portion 41 of the earth wire 22 should preferably be of a somehow larger size than the length of the conductor-grasping pair of tongues 60 for easy and rapid positioning and connection. The naked portion 41 of the earth wire 22 is positioned between the tongues 60*b* and 60*c*, and the tongues are calked as shown in FIG. 9, whereby the grasping pair 60 and the earth wire are connected. The sheathed portions adjoining the naked portion 41 are securely fixed to the grasping pairs 62 by calking the tongues 62*b* and 62*c*, respectively. In this embodiment of the present invention, the earth wire can be securely fixed at the connections with each terminal, without any possibility of its conductors being broken.

As apparent to those skilled in the art, the light assembly for use on vehicles according to the present invention is not limited to the embodiments having been illustrated and described in the foregoing.

What is claimed is:

1. A light assembly for use in vehicles, comprising:

a housing having a back plate and an opening opposite the back plate;

a lens for covering the opening of the housing;

a plurality of electroconductive sockets for containing light bulbs;

a socket holder corresponding to each socket including insulating material, a wall portion for supporting the corresponding socket said wall portion having an inner wall disposed adjacent the socket, and a cut in a top end of the wall portion;

an earth wire made of a coated conductor having stripped portions disposed at intervals corresponding to a distance between the socket holder, and being electrically connected to ground;

a terminal corresponding to each socket holder having a plurality of first tongue portions for being crimped about the stripped portions of the earth wire and for establishing electrical contact between the terminal and the earth wire, and having an electrical contact section for being forcibly fit into the cut in the socket holder, for being tightly disposed between the inner wall and the socket, and for establishing electrical contact between the socket and the earth wire.

2. A light assembly according to claim 1, wherein the electrical contact section of said terminal comprises at least one rib for being forcibly pressed between the socket and the socket holder and for providing a rigid connection.

3. A light assembly according to claim 2, wherein said socket holder comprises an outer wall away from the socket and wherein the terminal comprises a shoulder portion for being pressed against the outer wall and for supporting the terminal in the cut.

4. A light assembly according to claim 1, wherein said earth wire and said terminal corresponding to each socket holder are a single unit for being connected with said sockets and socket holders, and wherein said single unit comprises an end terminal for being connected with said back plate.

5. A light assembly according to claim 1, wherein said terminal comprises second tongue portions for being crimped about insulated sections of said earth wire adjacent said stripped portions, and for securely fixing the earth wire to the terminal.

* * * * *